US005731277A

United States Patent [19]

Gary et al.

[11] Patent Number: 5,731,277

[45] Date of Patent: Mar. 24, 1998

[54] AUTOMATIC DISHWASHING COMPOSITIONS CONTAINING ALUMINUM TETRAHYDROXIDE

[75] Inventors: Richard Gerald Gary, West New York, N.J.; Petrus Adrianus Johannes Marinus Angevaare, Den Haag, Netherlands; Arnold Oscar Jensen, Wesley Hills, N.Y.; Leonard Van Gorkom, Englewood, N.J.

[73] Assignee: Lever Brothers Company, Division of Conopco, Inc., New York, N.Y.

[21] Appl. No.: 668,151

[22] Filed: Jun. 21, 1996

[51] Int. Cl.[6] ..... C11D 18/02

[52] U.S. Cl. ..... 510/221; 510/222; 510/226; 510/227; 510/228

[58] Field of Search ..... 510/221, 222, 510/223, 224, 225, 226, 227, 228, 229

[56] References Cited

U.S. PATENT DOCUMENTS

| | | | |
|---|---|---|---|
| 3,255,117 | 6/1966 | Knapp et al. | 252/99 |
| 3,350,318 | 10/1967 | Green | 252/135 |
| 4,867,896 | 9/1989 | Elliott et al. | 252/94 |
| 4,954,280 | 9/1990 | Elliott et al. | 252/90 |
| 5,135,675 | 8/1992 | Elliott et al. | 252/103 |
| 5,599,781 | 2/1997 | Haeggberg et al. | 510/220 |
| 5,624,892 | 4/1997 | Angevaare et al. | 510/223 |

*Primary Examiner*—Paul Lieberman
*Assistant Examiner*—John R. Hardee
*Attorney, Agent, or Firm*—A. Kate Huffman

[57] ABSTRACT

A composition and method for inhibiting the extraction of transition metals from tableware washed in automatic dishwashers is described. The composition contains an aluminum species in which substantially all of the aluminum (III) ions are present as aluminum tetrahydroxide. A bleaching agent, a builder and optionally a surfactant and a silicate are present. The composition has a pH of less than about 10. A process for preparing the composition is also described.

4 Claims, No Drawings

AUTOMATIC DISHWASHING COMPOSITIONS CONTAINING ALUMINUM TETRAHYDROXIDE

FIELD OF THE INVENTION

This invention relates to automatic dishwashing detergent compositions containing aluminum tetrahydroxide which inhibits extraction of transition metals from tableware.

BACKGROUND OF THE INVENTION

It is known that detergent formulations having neutral pH or low alkalinity significantly corrode fine tableware, particularly lead crystal glassware. See Angevaare et al., U.S. Ser. Nos. 08/444,502 and 08/444,503. It is believed that the lead and boron minerals of the tableware take part in the formation of the silicate network. When such minerals are extracted the silicate network falls apart readily. This corrosion is especially pronounced when little or no silicate is incorporated in low alkalinity or neutral pH products. It has further been observed that detergent compositions incorporating aluminum salts to inhibit corrosion compromise cleaning and leave significant stains on washed tableware.

One solution used to address these problems was the incorporation of certain slow dissolving aluminum salts in automatic dishwashing compositions containing little to no silicate. See Angevaare et al., U.S. Ser. No. 08/444,502.

Although this solution is quite effective in both inhibiting tableware corrosion and providing good tea stain removal, the formulator has to selectively incorporate aluminum salts which dissolve at a particular rate thus severly limiting the selection of aluminum (III) species which are useful. Thus the prior art describes fast dissolving aluminum salts, which must be combined with greater than about 10 wt. % silicate in high alkalinity products, and which are not effective in both corrosion inhibition and in providing excellent cleaning performance in lower alkalinity detergents. See U.S. Pat. No. 3,350,318 (Green) and U.S. Pat. No. 3,255,117 (Knapp).

Another solution to the corrosion and performance problems is the combination of certain sequestrants and water soluble aluminum salts to form an aluminum/sequestrant premix which is subsequently mixed with remaining ingredients of the formula. Although an effective solution, the requirement of selecting specific pKas and pHs to form an aluminum/sequestrant premix adds an additional step to the process of forming the detergent compositions. Upon commercial scale up this additional step may add another factor for consideration in the process.

It is thus an object of the invention to provide compositions prepared by a process of incorporating a selected aluminum (III) species in automatic dishwashing detergent compositions to provide effective cleaning performance without tableware corrosion.

Another object of the present invention is to provide mild automatic dishwashing detergent compositions which not only protect against tableware corrosion but also provide good cleaning performance in removing stains from tableware.

SUMMARY OF THE INVENTION

The compositions of the invention are automatic dishwashing detergent compositions comprising:

a) 1 to 20 wt. % of a bleaching agent selected from a peroxygen agent, hypohalite agent, corresponding salts and mixtures thereof;

b) an effective amount, preferably 0.01 to about 25 wt. % of an aluminum (III) containing species in which substantially all of the aluminum (III) ions are present as aluminum tetrahydroxide;

c) 1 to 75 wt. % of a builder; and d) 0 to 40 wt. % of a surfactant; and e) 0 to 5 wt. % of a silicate.

A 1% aqueous solution of the automatic dishwashing composition has a pH in the range of less than about 10.

The compositions are prepared by first forming a solution of the aluminum containing species in water. It is essential that the pH value of the solution be increased to at least 12 or greater so that substantially all of the aluminum (III) species are present as aluminum tetrahydroxide (i.e. no more than about 10 wt. %, preferably no more than about 5 wt. %, most preferably no more than about 1 wt. % of any other aluminum species is present). Subsequently, the pH of the aluminum tetrahydroxide containing solution is reduced to a selected pH, that is to a pH of less than about 10.

The compositions of the invention may be in a variety of physical forms, preferably liquid, or gel.

DETAILED DESCRIPTION OF THE PREFERRED EMBODIMENTS

The compositions of the invention are effective cleaners which do not extract transition metals (e.g. lead, boron, barium, titanium, cadmium, etc.) from tableware, particularly lead containing tableware used for entertainment or decorative purposes. Such glassware generally has a high refractive index which gives the classic "sparkle" when cut into decorative shapes and may have a lead content of more than about 20% by weight.

Aluminum (III) Containing Salts

Aluminum salts which are useful in the composition and which may be processed to form the aluminum tetrahydroxide required in the present invention are described below.

Without being limited by theory it is noted that increasing the pH value of an aqueous solution containing an aluminum (III) species to a pH value of 12 or greater chemically changes the aluminum hexahydrate or polymeric aluminum species to aluminum tetrahydroxide which remains stable even though the pH is subsequently reduced. Substantially all aluminum species should be in the Al(OH)4 form and no more than about 10 wt. %, preferably no more than about 5 wt. %, most preferably no more than about 1 wt. % of the aluminum solution should contain another aluminum species, such as aluminum hexahydrate, etc. If other such aluminum species are present polymeric aluminum species may form in situ. Additionally, such other polymeric aluminum species may also form in the presence of builders, particularly polyphosphates. These polymeric species interact with stains on the dishware to negatively impact on stain removal.

Examples of aluminum salts which fall within this scope include sodium aluminate, aluminum sulfate, aluminum chloride, aluminum nitrate, aluminum stearate, aluminum tartrate, aluminum acetate, aluminum acetotartrate, aluminum salicylate, aluminum bis(acetylsalicylate), aluminum formate, aluminum octoate, aluminum borate, aluminum oleate, aluminum palmitate, aluminum acetylacetonate, aluminum phosphate and mixtures thereof. Preferred aluminum salts include: aluminum sulfate, aluminum chloride, sodium aluminate, aluminum acetate, aluminum acetylacetonate, and aluminum octoate. Most preferred aluminum salts include: aluminum sulfate, aluminum chloride and aluminum acetate.

The aluminum salt should be incorporated in the detergent composition in an amount to deliver about 0.1 mM to about 10 mM, preferably 0.5 mM to about 5 mM, most preferably about 1 mM to 2 mM Al(III) in the wash.

Alkalinity

The alkalinity of an aqueous solution of the compositions should be neutral to low alkalinity, less than a pH of 10, preferably 5 to 9, most preferably 7 to 9.

Any number of conventional buffer agents may be used to maintain the desired pH range. Such materials can include, for example, various water soluble inorganic salts such as the carbonates, bicarbonates, sesquicarbonates, pyrophosphates, phosphates, tetraborates and mixtures thereof.

The buffering agents should be present in the compositions in a amount of from about 2 to about 30 wt. %, preferably from 5 to about 25% by wt. of the total composition.

Peroxy Bleaching Agents

The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, epsilon-phthalimidoperoxyhexanoicacid and o-carboxybenzamido peroxyhexanoic acid, N-nonylamidoperadipic acid and N-nonylamidopersuccinic acid.

iii) Cationic peroxyacids such as those described in U.S. Pat. Nos. 5,422,028, 5,294,362; and 5,292,447, Atty. Docket No. 95-0394-UNI; Case 7392, Oakes et al.; and U.S. Ser. No. 08/210,973, Oakes et al., herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxyisophthalic acid viii) 2-decyldiperoxybutan-1,4-dioic acid ix) N, $N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimidoperoxyhexanoic acid, o-carboxybenzaminoperoxyhexanoicacid, and mixtures thereof.

The oxygen bleaching agent is present in the composition in an amount from about of 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,$N^1$,$N^1$-tetraacetylethylene diamine (TAED) and N,N,$N^1$,$N^1$-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzenesulfonate; and benzoic anhydride.

Preferred peroxygen bleach precursors are sodium p-benzoyloxybenzene sulfonate, N,N,$N^1$,$N^1$-tetraacetylethylene diamine, sodium nonanoyloxybenzene sulfonate and choline sulfophenyl carbonate.

Detergent Builder Materials

The compositions of this invention contains either organic builders, particularly carboxylates, or inorganic builders, particularly phosphorous containing compounds in an amount of from about 1 to 75 wt. %.

Phosphorus Containing Builders

Examples of phosphorus-containing inorganic builders include the water-soluble salts, especially alkali metal pyrophosphates, orthophosphates and polyphosphates, particularly ammonium and alkanol ammonium salts, and phosphonates. Particularly preferred phosphate builders include sodium and potassium tripolyphosphates, pyrophosphates, hexametaphosphates and trimetaphosphates. When a phosphate builder is incorporated into the formulas it is preferably present in an amount of about 10 to about 60% by wt., most preferably 15 to about 40 wt. %.

Nonphosphorus Inorganic Builders

Non-phosphorus-containing inorganic builders may be additionally used such as water-soluble alkali metal carbonates, bicarbonates, sesquicarbonates, borates, silicates, layered silicates such as SKS-6 ex Hoechst, metasilicates, phytic acid, borate and crystalline and amorphous aluminosilicates. Specific examples include sodium carbonate (with or without calcite seeds), potassium carbonate, sodium and potassium bicarbonates, silicates, including layered silicates and zeolites.

Organic Builders

Organic detergent builders useful in the present invention including a variety of polycarboxylate compounds. As used herein "polycarboxylate" refers to compounds having a plurality of carboxylate groups, preferably at least three (3) carboxylates. Monomeric or polymeric carboxylates are preferred. Such polycarboxylates include polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062, herein incorporated by reference.

Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, and polyhydroxysulfonates.

Alkali metal citrates, nitrilotriacetates, oxydisuccinates, polyphosphonates and acrylate/maleate copolymers and acrylate/maleate/vinyl alcohol terpolymers are especially preferred organic builders.

The foregoing detergent builders are meant to illustrate but not limit the types of builders that can be employed in the present invention.

Sequestrants

The detergent compositions herein may also optionally contain one or more iron and/or manganese co-chelating agents. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates)and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 3.0% by weight of such composition.

Anti-Scalants

Scale formation on dishes and machine parts is an important problem that needs to be resolved or at least mitigated in formulating a machine warewashing product, especially in the case of low-phosphate (e.g. less than the equivalent of 20% by weight, particularly 10% by weight of sodium triphosphate) and phosphate-free machine warewashing compositions, particularly zero-P machine warewashing compositions.

In order to reduce this problem, co-builders, such as polyacrylic acids or polyacrylates (PAA), acrylate/maleate copolymers, polyaspartates, ethylenediamine disuccinate and the various organic polyphosphonates, e.g. Dequest series, may be incorporated in one or more system components. For improved biodegradability, (as such co-builders), the block co-polymers of formula (I) as defined in published PCT patent specification WO 94/17170 may also be used. In any component, the amount of anti-scalant may be in the range of from 0.5 to 10, preferably from 0.5 to 5, and more preferably from 1 to 5% by weight.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R_2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms.

This will be the case when the moiety $R^2CH(-)CO_2(-)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)CO_2R^3$$

where the moiety $R^2CH(-)CO_2(-)$ is derived from a coconut source and $R^3$ is either methyl or ethyl.

Nonionic surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6-(CH_2\underset{\underset{R^7}{|}}{C}HO)_x(CH_2CH_2O)_y(CH_2\underset{\underset{R^8}{|}}{C}HO)_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(CH_2\underset{\underset{CH_3}{|}}{C}HO)_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositions in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF.

Another nonionic surfactant included within this category are compounds of formula:

$$R^{11}-(CH_2CH_2O)_qH$$

wherein $R^{11}$ is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitol tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)\ CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{12}R^{13}R^{14}N{=}O$$

wherein $R^{12}$, $R^{13}$ and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{15}O(R^{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^{15}$ being $C_9$–$C_{11}$, n is 0 and p is 1.3, 1.6 and 1.8–2.2 respectively; APG® 500 and 550 with $R^{15}$ is $C_{12}$–$C_{13}$, n is 0 and p is 1.3 and 1.8–2.2, respectively; and APG® 600 with $R^{15}$ being $C_{12}$–$C_{14}$, n is 0 and p is 1.3.

While esters of glucose are contemplated especially, it is envisaged that corresponding materials based on other reducing sugars, such as galactose and mannose are also suitable.

The amount of glycoside surfactant, anionic surfactant and/or ethoxylated fatty alcohol surfactant will be from about 0.5 to about 30% by weight of the composition. Desirably the total amount of surfactant lies in the same range. The preferred range of surfactant is from 0.5 to 20% by weight, more preferably from 0.5 to 10% by weight.

Filler

An inert filler material which is water-soluble may also be present in cleaning compositions. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 20%, preferably from about 2% to about 10% by weight of the cleaning composition.

Thickeners & Stabilizers

Thickeners are often desirable for liquid cleaning compositions. Thixotropic thickeners such as smectite clays including montmorillonite (bentonite), hectorire, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for machine dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine-resistant polymeric thickener is particularly useful. U.S. Pat. No. 4,260,528 discloses natural gums and resins for use in clear machine dishwashing detergents, which are not chlorine stable. Acrylic acid polymers that are cross-linked manufactured by, for example, B. F. Goodrich and sold under the trade name "Carbopol" have been found to be effective for production of clear gels, and Carbopol 940, 617 and 627, having a molecular weight of about 4,000,000 are particularly preferred for maintaining high viscosity with excellent chlorine stability over extended periods. Further suitable chlorine-resistant polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long-chain calcium and sodium soaps and $C_{12}$ to $C_{18}$ sulfates are detailed in U.S. Pat. Nos. 3,956,158 and 4,271,030 and the use of other metal salts of long-chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 0.01–5%. These co-structurants are more fully described in the co-pending U.S. Pat. No. 5,141,664 by Corring et al., filed Dec. 30, 1987, which application is hereby incorporated by reference.

Defoamer

The formulations of the cleaning composition comprising surfactant may further include a defoamer. Suitable defoamers include mono-and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%. Preferred antifoam systems are described in Angevaare et al. 95-158-EDG, herein incorporated by reference.

Enzymes

Enzymes capable of facilitating the removal of soils from a substrate may also be present in an amount of up to about 10% by wt., preferably 1 to about 5 wt. %. Such enzymes include proteases (e.g., Alcalase®, Savinase® and Esperase® from Novo Industries NS and Purafect OxP, ex. Genencor), amylases (e.g., Termamyl® and Duramyl® from Novo Industries and Purafect OxAm, ex. Genencor) (and lipases (e.g. Lipolase® from Novo Industries).

Silicates

If silicates are present in the compositions of the invention, they should be in an amount to provide neutral or low alkalinity (less than pH 10) of the composition. Preferred amounts of silicates present should be from less than to about 5%, most preferably 1 to 3 wt. %. Especially preferred is sodium silicate in a ratio of $SiO_2$:$Na_2$ up from about 1.0 to about 3.3, preferably from about 2 to about 3.2.

Optional Ingredients

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; enzyme stabilizing agents; soil suspending agents; antiredeposition agents; anti-corrosion agents, such as isocyanuric acid described in Angevaare, U.S. Pat. No. 5,374,369; ingredients to enhance decor care such as certain aluminum salts described in U.S. Ser. Nos. 08/444,502 and 08/444,503, herein incorporated by reference; colorants; perfumes; and other functional additives.

The following examples will serve to distinguish this invention from the prior art and illustrate its embodiments more fully. Unless otherwise indicated, all parts, percentages and proportions referred to are by weights.

Process

It is essential that the aluminum salt be dissolved in a relatively high pH aqueous solution (≧12) prior to the incorporation of other components of the compositions of the invention. The detergent compositon may be processed in any conventional manner to form a variety of physical forms of automatic dishwashing detergent compositions, preferably liquid or gel.

To prepare the compositions, a selected aluminum salt is first completely dissolved in water. The pH of the aluminum containing solution is then increased such that a pH value of a 1% solution is 12 or greater by the addition of either an inorganic acid or an inorganic base, such as NaOH or $H_2SO_4$.

The solution is maintained at the high pH for a period of time to chemically alter substantially all of the aluminum species to aluminum tetrahydroxide (i.e. no more than about 10 wt. %, preferably no more than about 5 wt. %, most preferably no more than about 1 wt. % any other Al (III) species). Generally this time period is five (5) minutes or more. Subsequently the pH of the aluminum tetrahydroxide solution is reduced to 10 or below. The solution can then be incorporated with other components to form the composition.

The following examples will serve to distinguish this invention from the prior art and illustrate its embodiments more fully. Unless otherwise indicated, all parts, percentages and proportions referred to are by weight.

EXAMPLE 1

It was surprisingly observed that at low and neutral pH levels (less than about pH 10) lead mineral from lead containing glassware was more substantially extracted than at higher pH. Specifically, lead containing glass tiles obtained from Q-Glass, Inc. of Towaco, N.J. and having a 50% lead content were soaked for 24 hours at 65° C. in one liter soft water containing 6.8 grams of an automatic dishwashing composition having the following formula:

TABLE 1

| Ingredient | % of Active |
|---|---|
| Chlorine bleach | 2.0 |
| Potassium tripolyphosphate | 34 |
| Polymer[1] | 1 |
| Buffering agents | 9 |
| Non-ionic surfactant | 2 |
| Potassium hydroxide (45% soln.) | 1 |
| Water | to balance |

[1]Carbopol 627, a high molecular polymer having a molecular weight of about one million supplied by B. F. Goodrich Company.

[1]Carbopol 627, a high molecular polymer having a molecular weight of about one million supplied by B. F. Goodrich Company.

The pH's of the four solutions were adjusted to 7.5, 8.6, 9.5, and 10.5 with NaOH and $H_2SO_4$. After soaking, the lead containing glass tiles and an aliquot of each detergent solution were withdrawn. The lead tiles were weighed to determine weight loss. The aliquots were analyzed for metals using Inductively Coupled Plasma (ICP) spectrometry. The results of each analysis are presented in Table 2 below:

TABLE 2

| pH Value | Weight loss (%) | Lead Extracted (ppm) |
|---|---|---|
| 7.5 | 0.30 | 170 |
| 8.6 | 0.30 | 155 |
| 9.5 | 0.20 | 90 |
| 10.5 | 0.07 | 30 |

Thus, as the alkalinity of the detergent compositions increased above about 10, the amount of lead extracted from the lead articles significantly decreased.

EXAMPLE 2

It was observed that the addition of selected aluminum salts to the automatic dishwashing composition of Example 1 significantly reduced the lead extracted from the lead containing glass tiles after soaking in a detergent solution.

Detergent solutions according to Example 1 and further containing various aluminum salts to deliver 2.2 millimoles Al(III) per liter were prepared. Lead containing glass tiles were soaked in the detergent solutions under the conditions described in Example 1 except that the pH's of the detergent solutions were maintained at 8.6. After soaking, aliquots of the solutions were analyzed using ICP to determine the amount of lead extracted into the detergent solution. The results of the experiment are presented in Table 3 below:

TABLE 3

| Detergent Compositions | Extracted Lead in ppm |
|---|---|
| Control (No aluminum salt) | 155 |
| Aluminum stearate | 35 |
| Aluminum acetate | 35 |
| Aluminum acetylacetonate | 65 |
| Aluminum phosphate | 70 |

It was thus observed that the addition of aluminum salts to the low alkalinity detergent solutions significantly reduced the amount of lead extracted from the lead containing articles.

EXAMPLE 3

To observe the effect of the presence of aluminum salts in an automatic dishwashing detergent composition, lead containing articles of having decors of various colors were washed in a dishwasher and the fading of the decor of the articles was scored.

Compositions according to Example 1 were prepared using various aluminum salts to deliver Al(III) in an amount of 2.2 millimoles Al(III) per liter in the dishwasher. A 1% solution of each of the compositions had a pH of 8.6. The following articles were washed in a Bauknecht dishwasher for 15 washes in soft water: 1 yellow plate, 1 red plate, 1 blue glass, 1 tweety glass and 1 orange glass. After the 15 washes, the articles were removed and scored for fading of decor from 0 (no fading) to 6 (substantially faded). The scored results are exhibited in Table 4 below:

TABLE 4

| Composition | Yellow Plate | Red Plate | Blue Glass | Tweety Glass | Orange Glass |
|---|---|---|---|---|---|
| Control (No aluminum salt) | 5 | 5 | 5 | 5 | 5 |
| Aluminum sulfate | 1 | 1.5 | 1.5 | 1.5 | 1.5 |
| Aluminum acetate | 0 | 0.5 | 1.5 | 0.5 | 2 |
| Aluminum acetylace-tonate | 0.5 | 1.5 | 1 | 1.5 | 0.5 |
| Aluminum ocoate | 1 | 1.5 | 1.5 | 3 | 3.5 |
| Aluminum phosphate | 4.5 | 3.5 | 4 | 5 | 5 |

It was observed that all the aluminum salt containing compositions exhibited less decor fading than those compositions which did not contain aluminum salts.

EXAMPLE 4

It has been observed that the presence of an aluminum salt can negatively impact the removal of stains, particularly tea stain, under the conditions obtained by using these detergent compositions. This is most likely caused by a direct interaction between aluminum and the stain. It has been also found that controlling the release of aluminum can minimize this negative impact.

To observe the effect of the presence of aluminum salts in an automatic dishwashing detergent composition on tea stain removal, tea stained cups and saucers were washed in the dishwasher and scored with regard to stain removal.

A composition according to Example 3 was prepared using aluminum sulfate to deliver Al(III) in an amount of 2.2 millimoles Al(III) per liter in the dishwasher. A 1% solution of each of the compositions had a pH of 8.6. For each experiment, eight cups and eight saucers were stained in a tea liquor and allowed to dry. Four cups and four saucers of the original eight were stained an additional three times, yielding four cups and saucers stained once, and four cups and saucers stained four times. Half of these articles were washed one (1) time in water containing 250 ppm permanent/320 ppm temporary hardness with the composition described above and half were washed in the control composition. The scored results are exhibited in Table 5 below:

TABLE 5

| Composition | 4× cup | 4× saucer | 1× cup | 1× saucer |
|---|---|---|---|---|
| Control (No aluminum salt) | 0 | 0 | 0 | 0 |
| Aluminum sulfate | 5 | 5 | 5 | 5 |

It has thus been found that the incorporation of aluminum salts into these detergent compositions can negatively impact the removal of stains, particularly tea stains. This is most likely found caused by the in situ formation of a polymeric aluminum species which subsequently interacts with the stain. It has also been surprisingly found that controlling the method by which the aluminum salt is incorporated into the formulation can mitigate this negative consequence.

To observe the effect of the incorporation of aluminum salts in an automatic dishwashing detergent composition on tea stain removal, tea stain cups and saucers were washed in the dishwasher and scored with regard to stain removal.

Dishwashing formulations according to the composition described in Table 6 were prepared as follows:

TABLE 6

| Ingredient | % of Active |
|---|---|
| Aluminum sulfate | 2 |
| Polymer | 1 |
| Potassium tripolyphosphate | 34 |
| Non-ionic surfactant | 2 |
| Buffering agents | 9 |
| Potassium hydroxide (45% solution) | 5 |
| Chlorine bleach | 4.3 |
| Water | to balance |

The components of these formulations were admixed in the order from top to bottom in Table 6.

EXAMPLE 5

Two detergent compositions, Samples A & B (below) were prepared to compare tea stain removal of the inventive composition vs. the prior art composition. To prepare Sample A, aluminum sulfate was dissolved in water and was allowed to remain at its dissolution pH of 3.5. The pH of this solution was statted for ten minutes. The remainder of the components described in Example 4, Table 6 were added in the normal fashion, and the pH of the finished composition was adjusted to 9.0 using $H_2SO_4$ and NaOH.

To prepare Sample B, aluminum sulfate was dissolved in water to form a solution having a pH of 3.5. The pH of the solution was increased to 12.5 using $H_2SO_4$ and NaOH. The pH of this solution was statted for ten minutes, then decreased to a pH of 9.0 using $H_2SO_4$ and NaOH. The remainder of the components were added conventionally, and the pH of the finished composition was adjusted to 9.0 using $H_2SO_4$ and NaOH.

A 1% solution of each of the compositions had a pH of 8.6. For each experiment, four Buffalo China teacups and four Arcopal teacups were stained in a tea liquor and allowed to dry. The Buffalo China teacups were stained an additional three times, yielding four tea cups stained four times. The Arcopal teacups were stained one additional time, yielding four Arcopal teacups stained twice. Each of these articles was washed one (1) time in water containing 250 ppm permanent/320 ppm temporary hardness with the compositions described above. The scored results are exhibited in Table 7 below:

TABLE 7

| Composition | 4× Buffalo China Teacups | 2× Arcopal Teacups |
|---|---|---|
| Control | 0.5 | 0 |
| Sample A - aluminum sulfate solution at pH 3.5 | 4.8 | 4.5 |
| Sample B - aluminum sulfate solution at pH 12.5 | 0 | 0.4 |

From the above, it was observed that increasing the pH of the aluminum sulfate solution to a pH of 12.5 prior to the incorporation of the aluminum containing solution in the formulation results in significantly improved bleaching of tea stains by the inventive formulation as compared to simply incorporate the aluminum sulfate solution at its dissolution pH.

EXAMPLE 6

The effect of incorporating an aluminum containing solution prepared according to the invention in a formula containing a nonphosphate builder was observed. Formulations according to Example 5 were prepared, except 30 wt. % sodium citrate was substituted for the potassium tripolyphosphate builder. Tea stain removal of the formulations comprising aluminum were evaluated as compared to a control, with the following observed results:

TABLE 8

| Composition | 4× Buffalo China Teacups | 2× Arcopal Teacups |
|---|---|---|
| Control | 0.5 | 0.5 |
| Aluminum sulfate solution at pH 3.5 | 2.8 | 0.8 |
| Aluminum sulfate solution increased to pH 12.5 | 0.3 | 0 |

It was observed that the inventive formulation significantly improved tea stain bleaching in comparison to the conventionally prepared formulation. Additionally, the inventive formulations performed equally as well regardless of whether the builder was a phosphorus containing builder or a nonphorous containing builder. The performance in tea stain removal using the citrate containing inventive formula was observed to be equally as beneficial as the performance of the phosphorus containing formula over the extended test period of three months.

EXAMPLE 7

It was observed that the addition of up to about 7 wt. % silicate in a dishwashing composition containing aluminum ions had no beneficial effect on inhibiting decor fading when compared to dishware washed in compositions containing aluminum ions above.

The following compositions substantially described in Example 4 were prepared:

TABLE 9

| Ingredient | Weight % in Formulation | | | | | |
|---|---|---|---|---|---|---|
| | Sample 1 | Sample 2 | Sample 3 | Sample 4 | Sample 5 | Sample 6 |
| Polymer[1] | 1.0 | 1.0 | 1.0 | 1.0 | 1.0 | 1.0 |
| Al(III)* | 0.0 | 0.0 | 0.0 | 0.0 | 0.4 | 0.4 |
| Chlorine*[2] | 2.2 | 2.2 | 2.2 | 2.2 | 2.2 | 2.2 |
| Potassium tripoly-phosphate | 34.0 | 34.0 | 34.0 | 34.0 | 34.0 | 34.0 |
| Sodium silicate*[3] | 0.0 | 1.0 | 6.8 | 6.6 | 0.0 | 6.6 |
| Buffer | 9.0 | 9.0 | 9.0 | 9.0 | 9.0 | 3.0 |
| Potassium hydroxide (45%) | 1.0 | 1.0 | 1.0 | 1.0 | 1.0 | 1.0 |
| Water | to balance | to balance | to balance | to balance | to balance | to balance |
| pH of a 1% solution | 8.6 | 9.3 | 9.3 | 9.3 | 8.6 | 8.6 |

*For each of the samples, this ingredient was added to the mainwash at a level that corresponds to the specified weight percent in the formulation.
[1]Carbopol 627, a high molecular polymer having a molecular weight of about one million supplied by B. F. Goodrich Company
[2]Chlorine supplied as CDB-56, which is 56% available chlorine
[3]$SiO_2$:$Na_2O$ of 2.8

Dishware having decors of various colors were washed in a dishwasher and the fading of the decor was visually observed and scored from 0 (no fading) to 6 (substantially faded) as described in Example 3 on page 22 of the specification.

It was observed that formulations which did not contain the aluminum ions according to the invention exhibited substantial fading and little to no corrosion inhibition was observed (i.e. Samples 1–4).

In contrast dishware washed in the composition of Sample 5 containing the aluminum ions exhibited substantially no fading of the decors.

Dishware washed in the composition of Sample 6 containing both the aluminum ions and 6.6% silicate exhibited no benefit from decor fading over the fading observed for the dishware washed in the composition containing aluminum only (Sample 5).

Thus only the presence of the aluminum (III) ions in the compositions of the invention prevented corrosion of the decors of the washed dishwares and further the presence of silicate in the compositions up to an amount of about 7 wt. % had no beneficial effect on inhibiting decor fading.

EXAMPLE 8

The incorporation of aluminum sulfate according to the invention does not degrade the performance of the aluminum (III) ions to mitigate decor fading. A formulation according to Example 4, Table 6 was prepared and the ability of this formulation to mitigate decor damage was evaluated.

Dishware having decors of various colors and types were washed in a dishwasher and the fading of the decor was visuaally evaluated from 0 (no fading) to 6 (substantially faded) as described in Example 3 of this specification.

TABLE 10

| Composition | Red Plate | Yellow Plate | Yellow Glass | Blue Glass | Mickey Glass |
|---|---|---|---|---|---|
| Control (No aluminum salt) | 3.5 | 4.5 | 4.5 | 4 | 5 |
| Aluminum sulfate according to the invetion | 2.5 | 1 | 1.5 | 1.5 | 2 |

We claim:

1. A process for preparing an automatic dishwashing detergent composition comprising the steps of:

a) dissolving an aluminum salt in water to form an aluminum containing solution;

b) increasing a pH of the aluminum containing solution to a range of 12 or greater to substantially convert the aluminum in solution to aluminum tetrahydroxide;

c) decreasing the solution pH to a range of 10 or less;

d) incorporating the aluminum tetrahydroxide solution with 1 to 20 wt. % of a bleaching agent, 1 to 75 wt. % of a builder, 0 to 5 wt. % of a silicate and 0 to 40 wt. % of a surfactant to form a detergent composition wherein a 1% aqueous solution of the composition has a pH of 10 or less.

2. A process according to claim 1 wherein the bleaching agent is selected from the group consisting of a peroxygen agent, a hypohalite agent, corresponding salts and its mixtures thereof.

3. A process according to claim 1 wherein the aluminum salt is selected from the group consisting of sodium aluminate, aluminum sulfate, aluminum stearate, aluminum tartrate, aluminum acetate, aluminum acetotartrate, aluminum salicylate, aluminum bis(acetylsalicylate), aluminum formate, aluminum borate, aluminum palmitate, aluminum acetylacetonate, aluminum phosphate, aluminum octoate, aluminum oleate and mixtures thereof.

4. A process according to claim 1 wherein the builder is an inorganic or organic water soluble builder salt and mixtures thereof.

* * * * *